US005385518A

United States Patent [19]

Turner

[11] Patent Number: 5,385,518

[45] Date of Patent: Jan. 31, 1995

[54] WATER TRAMPOLINE

[76] Inventor: Noble H. Turner, 372 Puuikena Dr., Honolulu, Hi. 96821

[21] Appl. No.: 141,089

[22] Filed: Oct. 26, 1993

[51] Int. Cl.[6] ..... A63B 5/11

[52] U.S. Cl. ..... 482/27; 482/23

[58] Field of Search ..... 482/27, 28, 29, 23; 441/40, 129, 131; 182/139, 138

[56] References Cited

U.S. PATENT DOCUMENTS

| | | | |
|---|---|---|---|
| 1,456,168 | 5/1923 | Witmer et al. . | |
| 2,066,182 | 2/1936 | Lenz | 482/28 |
| 2,173,963 | 9/1939 | Eubank . | |
| 3,080,584 | 3/1963 | Brown . | |
| 3,095,947 | 7/1963 | Beaulaurier . | |
| 3,130,816 | 4/1964 | Wright . | |
| 3,469,844 | 9/1969 | Sindelar . | |
| 3,734,496 | 5/1973 | Rubin . | |
| 4,139,192 | 2/1979 | McNeil . | |
| 4,162,063 | 7/1979 | Nissen et al. . | |
| 4,516,768 | 5/1985 | Gallaro . | |
| 4,576,375 | 3/1986 | Roberts . | |
| 4,598,904 | 7/1986 | Roth . | |
| 4,644,892 | 2/1987 | Fisher . | |

FOREIGN PATENT DOCUMENTS

| | | | |
|---|---|---|---|
| 64359 | 11/1982 | European Pat. Off. . | |
| 275718 | 7/1988 | European Pat. Off. . | |
| 0473445 | 3/1992 | European Pat. Off. | 482/27 |
| 0542455 | 5/1993 | European Pat. Off. | 482/27 |
| 2333672 | 1/1975 | Germany . | |
| 1020677 | 2/1966 | United Kingdom . | |
| 2107201 | 4/1983 | United Kingdom . | |

*Primary Examiner*—Ronald J. Apley
*Assistant Examiner*—Lynne A. Reichard
*Attorney, Agent, or Firm*—Watson, Cole, Grindle & Watson

[57] ABSTRACT

A plurality of interconnected suspension members have reinforced upper and lower edges and extend around the outer periphery of a hollow inflatable support. The upper portions of the suspension members are connected by springs to the outer edge of an elastic trampoline mat. The lower portions of the suspension members are connected by a plurality of rigid connector members to spaced points on an annular retaining member having opposite ends adjacent one another. A turnbuckle is connected to the ends of the retaining member for adjusting the distance between the ends to control the tension of the suspension members. A sleeve of cushioning material surrounds each of the springs, and an annular cover overlies all of the sleeves.

21 Claims, 4 Drawing Sheets

WATER TRAMPOLINE

BACKGROUND OF THE INVENTION

The invention relates to a trampoline which is particularly adapted for use on water, although it may also be employed on other surfaces if so desired. A trampoline for use in either fresh or salt water should require minimal or no maintenance except for a hosing-down from time to time. The device should be capable of remaining in the water continuously, and in the case of being in the ocean, barnacles must be brushed off every few months. The trampoline should be environmentally friendly so that it will not pollute the water.

It is important that a water trampoline be of simple and inexpensive construction and be a self-contained unit. It must be durable and easy to set up and dismantle so that it can be readily moved from place to place. It should also have a substantial capacity so that a number of persons can be supported around the perimeter of the device while one or two people jump in the center thereof.

SUMMARY OF THE INVENTION

The present invention accomplishes the above objectives with a simple construction which may be set up and dismantled with a minimum of effort by a single person. The trampoline designed for adults may have a width of about twenty feet, while a trampoline designed for children may have a width of about twelve, each of such trampolines having a height of about three feet and weight of less than four-hundred pounds. An adult trampoline will support up to fifteen persons around the perimeter there of while one or two persons are jumping in the center of the trampoline mat.

The trampoline includes an inflatable support of toroidal construction which is adapted to float on the surface of a body of water. A trampoline mat has a plurality of springs connected to the outer edge of the mat. The springs are also connected to the upper portion of a suspension means which extends around the support means with the inner surface of the suspension means in engagement with the support means. Retaining means is connected to spaced points on the lower portion of the suspension means for retaining the lower portion of the suspension means in position and holding the suspension means in a precise operative position relative to the support means when the support means is inflated.

DESCRIPTION OF THE PREFERRED EMBODIMENT

Figure 3:
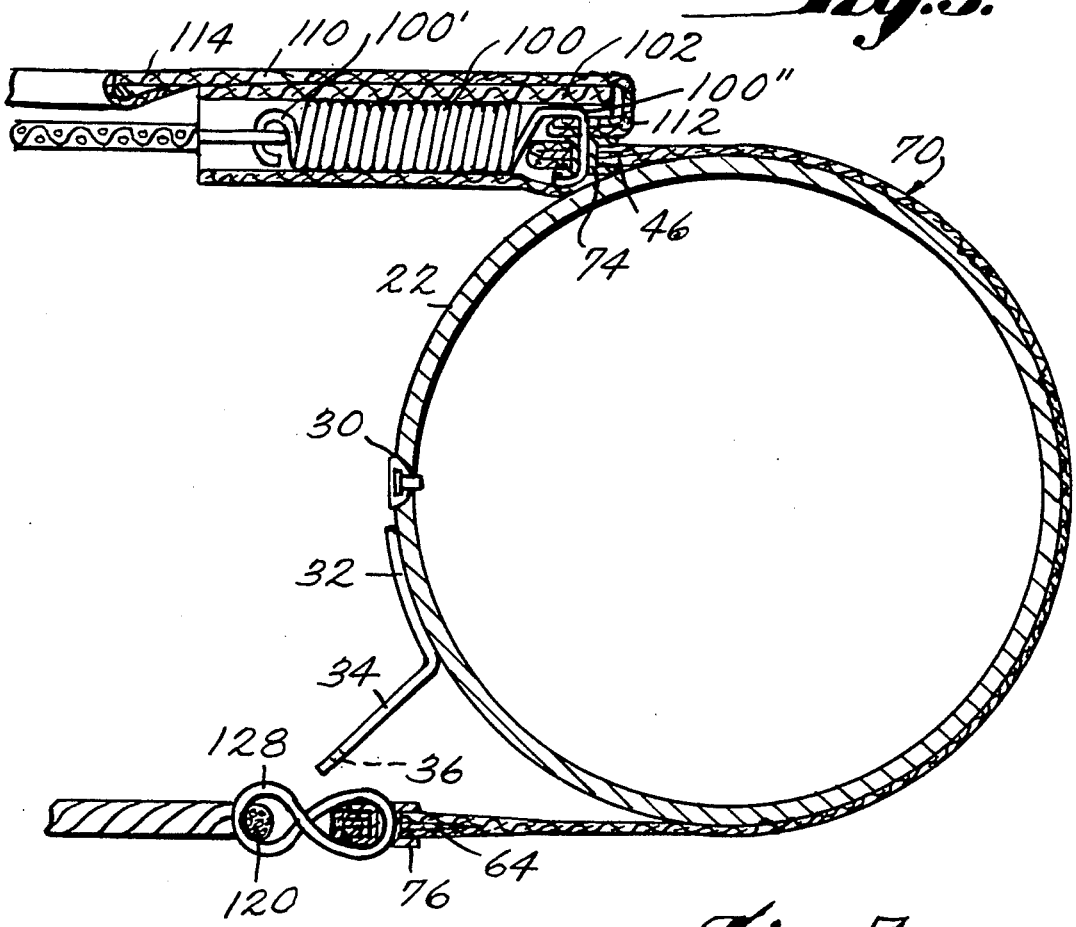
FIG. 3 is an enlarged sectional view showing the manner in which the suspension means is connected to the trampoline mat and the associated retaining means.
Figure 4:
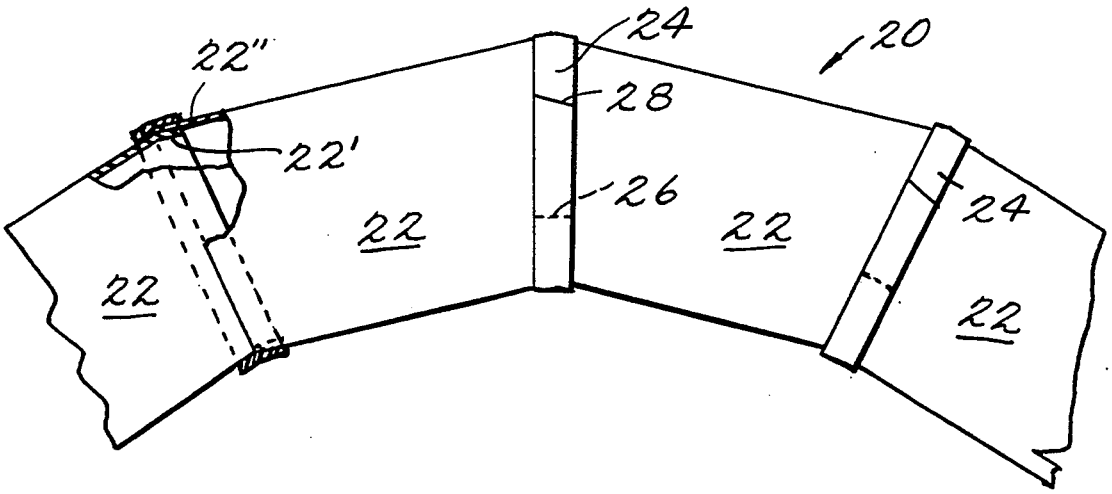
FIG. 4 is a top view, partly broken away, showing the construction of the inflatable support means.

Referring now to the drawings wherein like reference characters designate corresponding parts throughout the several views, as seen in FIG. 4, an inflatable support means indicated generally by reference numeral 20 is formed of fourteen similar support members 22 each of which has the configuration of a hollow truncated cylinder. Members 22 are formed, for example, of polyester reinforced PVC or any similar waterproof substance which is of heavy duty construction and which withstands all weather conditions. As seen in the broken away portion of FIG. 4, each member 22 has one end 22' thereof inserted in the end 22'' of an adjacent member 22. The joint between adjacent members 22 is sealed by a Strip of material 24 formed of material similar to members 22, the strip starting at 26 and continuing around the joint and overlapping itself to end at 28. Each of strips 24 is attached to adjacent members 22 by means of a conventional radio frequency heat sealing process which is also employed for attaching other components of the device to one another. As seen in FIG. 3, one of the support members 22 has a conventional recessed air valve 30 mounted therein for inflating the support means. The height of bounce from the trampoline mat may be regulated by the amount of air in the support means. A tie down flap 32 formed of the same material as the support members is heat sealed to the inner periphery of member 22 and includes a freely movable depending portion 34 having a hole 36 formed therethrough for receiving tie down ropes hereinafter described. Three similar tie down flaps are secured at equally spaced points about the inner periphery of the support means. This arrangement ensures that anchor means connected to the device will be disposed directly under the unit to avoid potential injury.

Figure 5:
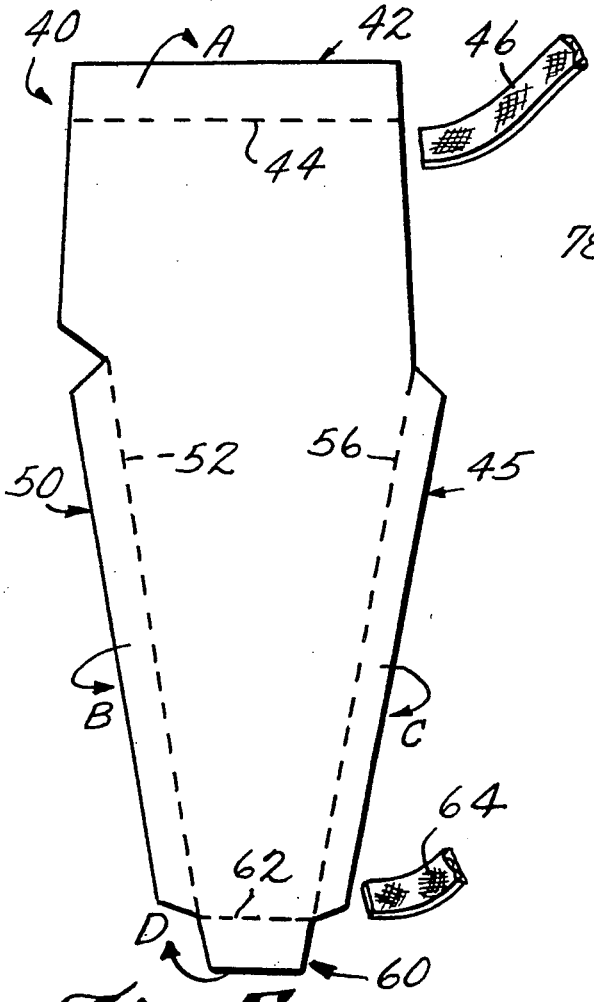
FIG. 5 is a view of a blank from which a suspension member of the device is formed.

Referring now to FIG. 5, a blank 40 from which a suspension member is formed is illustrated. The blank is of the same material as the support members, and the lower part thereof has a generally triangular shape which enhances a smooth non-wrinkle look from a distance. The blank includes an upper edge portion 42 which is adapted to be folded under in the direction of arrow A along a fold line 44. A strip of reinforcing material such as Nylon mesh 46 is sandwiched between the undersurface of blank 40 and the folded under upper edge portion 42 of the blank. Strip 46 is subsequently secured in position as hereinafter described.

The blank includes a first side edge portion 50 which is adapted to be folded under in the direction of arrow B along a fold line 52. A second side edge portion 54 is adapted to be folded under in the direction of arrow C along a fold line 56. A lower edge portion 60 is adapted to be folded under in the direction of arrow D along a fold line 62, and a strip of reinforcing Nylon mesh 64 is sandwiched between the undersurface of blank 40 and the folded under lower edge portion 60 of the blank. Strip 64 is subsequently secured in position as hereinafter described.

Figure 6:
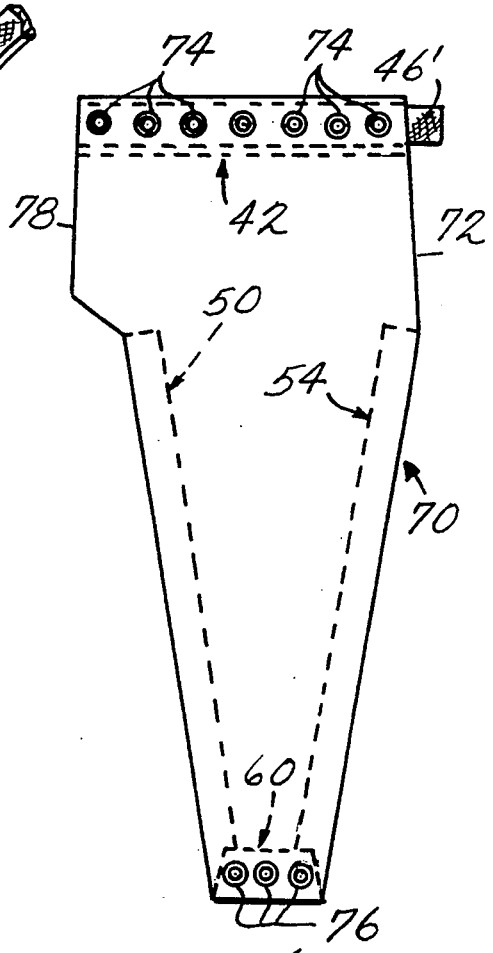
FIG. 6 is a view of a completely formed suspension member as incorporated in the assembled suspension means.

Referring to FIG. 6, a completely formed suspension member 70 as incorporated in the assembled suspension means is illustrated. The upper edge portion 42 has been folded under to sandwich the strip of Nylon mesh, with a portion 46' of the mesh extending to the right of edge 72 of member 70. The upper edge portion and the strip of mesh have been heat sealed to one another in a subsequent step in the manufacture of the suspension means. Seven conventional metal grommets 74 have been inserted through the elements after they are heat sealed to one another. The lower edge portion 60 has been folded under to sandwich the strip of Nylon mesh 64 between the lower edge portion 60 and the undersurface of member 70, these elements being heat sealed to one another. Conventional metal grommets 76 are inserted through the heat sealed elements for receiving the ends of three connector means hereinafter described.

Figure 7:
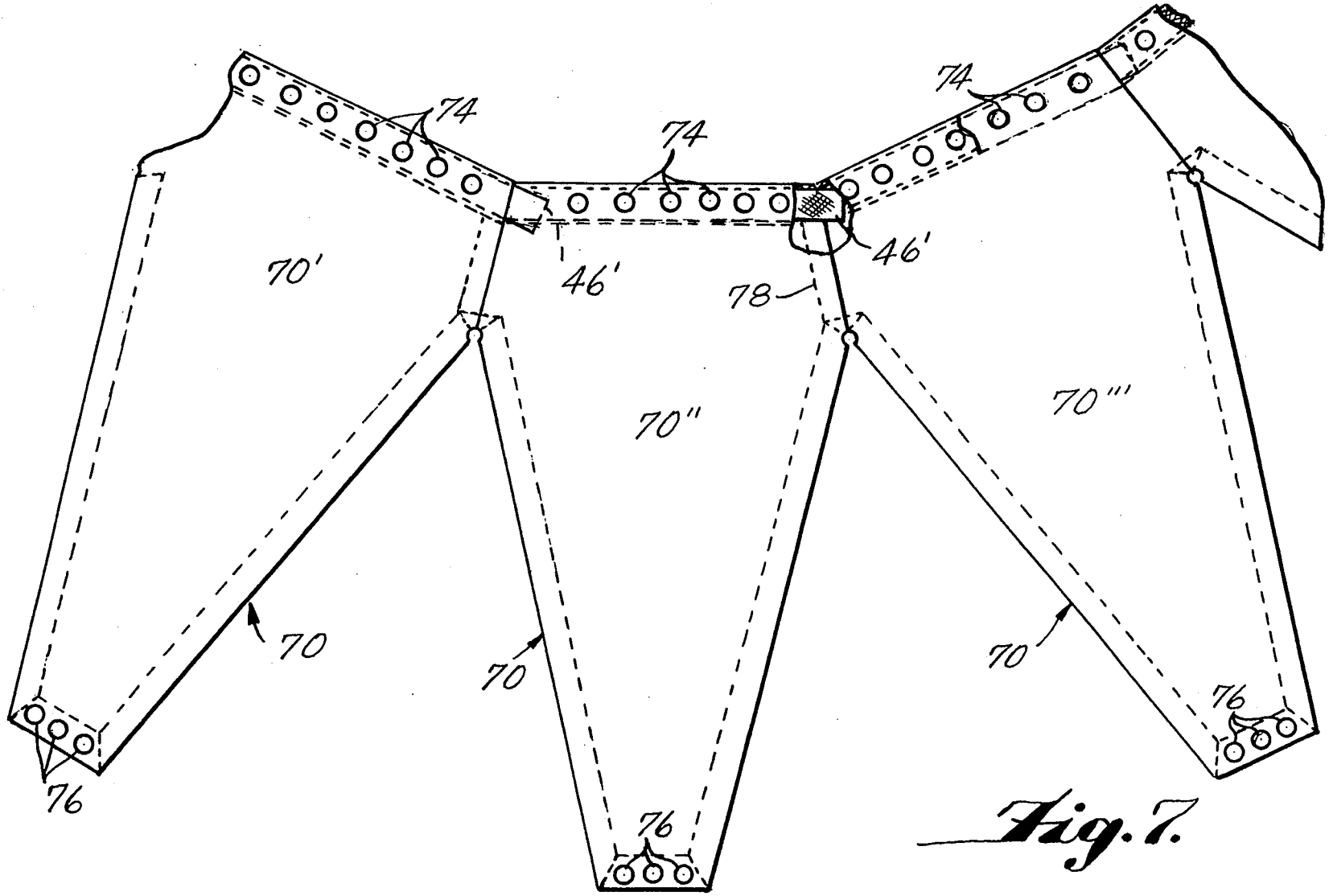
FIG. 7 is a top view of a portion of the assembled suspension means.

Referring now to FIG. 7, the manner in which the suspension members 70 are interconnected with one another is illustrated. The suspension members are fourteen in number, one suspension member being provided corresponding to each individual support member 22. Three members 70' 70" and 70"' are shown as being interconnected with one another. Assuming that one starts with member 70', the upper edge portion of member 70" is moved into position such that the edge 78 thereof as seen in FIG. 6 is moved under member 70' into the position shown in FIG. 7 so that the upper right-hand portion of member 70' overlaps the upper left-hand portion of member 70". As this step is being carried out, the portion 46' of the mesh disposed within the upper edge portion of member 70' is inserted into the upper edge portion of member 70' so that the Nylon mesh strips of members 70' and 70' overlap one another.

The method of assembling members 70" and 70"' is identical to that discussed above in connection with members 70' and 70" so that the Nylon mesh strips of each pair of adjacent suspension members overlap one another to reinforce the seams between the suspension members and preventing tearing at these locations. After the suspension members and the mesh strips have been properly assembled, all of the elements engaging one another are heat sealed together, and the grommets 74 are inserted through the heat sealed elements.

Figure 8:
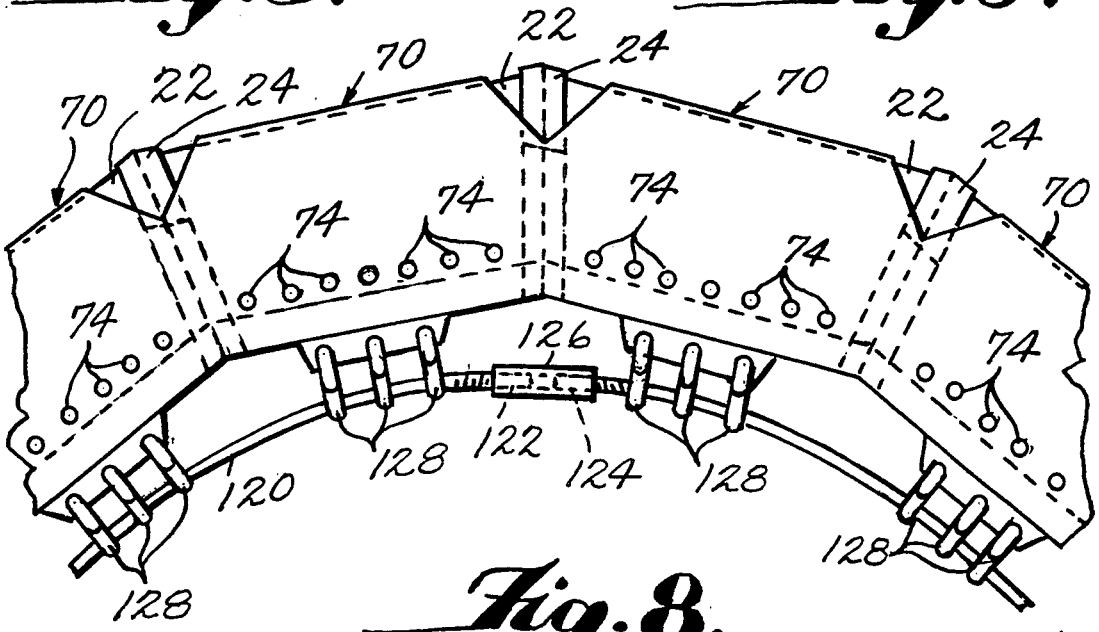
FIG. 8 is a top view of the support means with the suspension means disposed thereon and connected to the retaining means.

Referring to FIG. 8, the assembled suspension means formed of the fourteen suspension members 70 is shown on the support members 22 in the operative relationship they assume when the support means is inflated and the suspension members are in position to support the trampoline mat. In this operative position, each of the suspension members extends around one of the support members with the inner surface of each of the suspension members in engagement with the support members.

Figure 1:
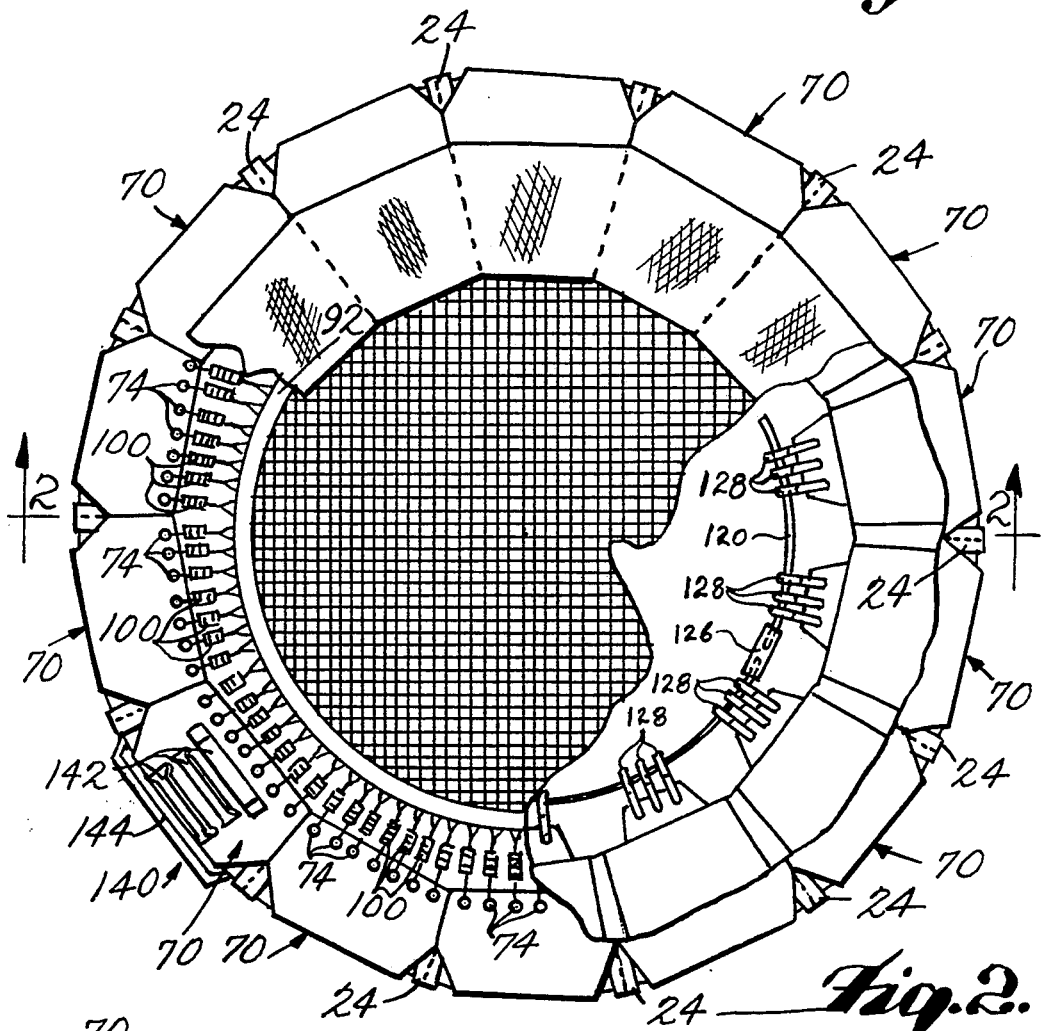
FIG. 1 is a top view, partly broken away, of a water trampoline according to the invention.
Figure 9:
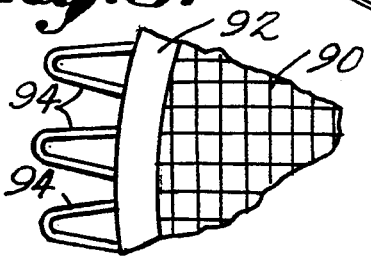
FIG. 9 is a top view on an enlarged scale of a portion of the outer edge of the trampoline mat.

As seen in FIGS. 1 and 9, a trampoline mat 90 is formed of a salt water and ultraviolet radiation resistant fabric which is woven to be about fifty to sixty percent open. The mat has an edge portion 92 which is provided with conventional triangular shaped attaching members 94. The attaching members are formed of stainless steel and have a plastic coating. The triangular shape defines a central opening within the attaching members for receiving the hooked end of a conventional trampoline spring. The mat is designed with a slightly softer center which provides a natural tendency for a jumper to stay in the middle of the circular mat. A plurality of conventional trampoline springs 100 are provided and comprise one and one-half inch thick high quality stainless steel with electroplate painting. These springs include the usual opposite hooked ends.

As seen in FIG. 1, one hooked end of each of springs 100 is received within a grommet 74 at the upper portion of one of the suspension members 70. The opposite hooked end of each spring is received through the opening within one of the attaching members 94. In this manner, the trampoline mat is supported about the entire periphery thereof by springs which are in turn supported by the suspension means.

As seen in FIG. 3, a protective sleeve 102 formed of suitable cushioning material such as foam rubber is disposed in surrounding relationship to each of the springs 100. The sleeve extends beyond the opposite hooked ends 100' and 100" of the associated spring so as to cover the attaching members 94 and the grommets 74. The sleeve ensures that a person will not be injured by the metal components supporting the trampoline mat in operative position.

As a further safety feature, an annular cover 110 is disposed in overlying relationship to all of the protective sleeves to prevent any part of the anatomy a person using the trampoline from going between adjacent ones of the springs. Cover 110 is formed of Nylon netting having an outer edge portion 112 which is doubled upon itself and stitched together to provide a reinforced outer edge at the periphery thereof which is adapted to receive the hooked end 100" of the springs as seen in FIG. 3 to hold the outer portion of the cover in place. The inner edge portion of the cover is provided with a channel for receiving a drawstring 114 which is of conventional construction and may be formed of Nylon rope. The drawstring is tightened to hold the cover firmly in place, yet enables the cover to be readily removed when so desired.

As seen in FIGS. 1, 3 and 8, retaining means for retaining the suspension means in operative position includes a retaining element 120 in the form of a stainless steel cable disposed adjacent the lower ends of the suspension members and having threaded end portions 122 and 124 which are threaded into opposite ends of a conventional turnbuckle 126. A plurality of spaced connector means 128 are provided for connecting retaining element 120 to the lower ends of the suspension members. Connector means 128 may be in the form of S-shaped metal clamps one end of which receives the retaining element 120 and the other end of which passes through the central opening of one of the grommets 76. The S-shaped clamps are then deformed by pliers into a generally figure eight configuration as seen in FIG. 3 to permanently interconnect the retaining element with the lower portions of the suspension members. The turnbuckle is used for adjusting the distance between end portions of the retaining element to thereby control the tension of the suspension means when in operative position. This arrangement holds the suspension members at exactly the correct position when the support means is inflated.

Figure 2:
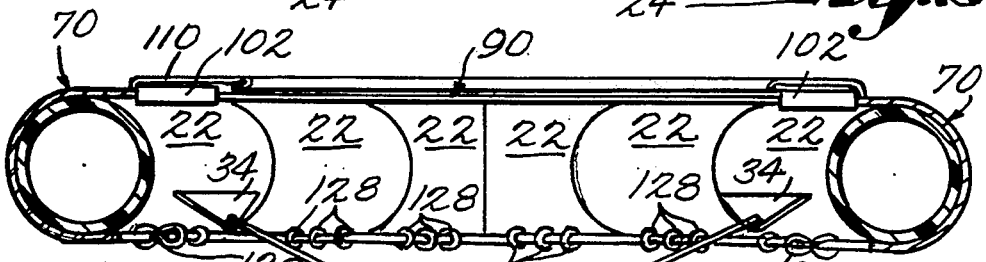
FIG. 2 is a sectional view taken along line 2–2 of FIG. 1 looking in the direction of the arrows.

As seen in FIG. 2, the tie-down flaps 34 are connected to tie-down Nylon ropes 130 which are in turn connected to a fitting 132. The fitting is also connected to a further rope 134 which extends downwardly to a heavy weight or anchor (not shown) for securing the water trampoline to the bottom of an ocean, lake or river. Since the weight is suspended from three equally spaced points on the support means, the weight or anchor will be disposed directly under the device to avoid potential injury to persons using the trampoline.

Figure 10:
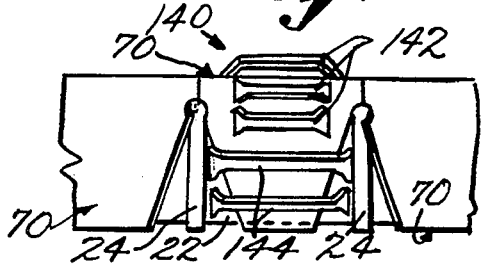
FIG. 10 is a side view of the ladder means of the device.

As seen in FIGS. 1 and 10, the device is provided with a ladder indicated generally by reference character 140 which comprises a plurality of conventional handles formed of hard rubber or other suitable substance, the handles being secured to the trampoline by cold gluing. The ladder includes three spaced relatively short handles 142 which are attached at the opposite ends thereof to one of the suspension members 70. A spaced pair of longer handles 144 have the opposite ends thereof attached to the outer surface of one of the support members 22. The handles are spaced from one another and disposed on the trampoline so as to enable a person to readily climb onto the device from the surrounding water.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A water trampoline comprising a hollow inflatable support means having an inner periphery and an outer periphery, said inner periphery defining a space therewithin, means for inflating said support means with air, an elastic trampoline mat having an outer edge, a plurality of springs operatively connected to said outer edge, suspension means having an upper portion and a lower portion and an inner surface, the upper portion of said suspension means being connected to said springs, said suspension means extending around said support means, and retaining means connected to spaced points of said lower portion of the suspension means for retaining the lower portion of said suspension means in operative position, said retaining means including an elongated retaining element having opposite ends disposed adjacent one another, and a plurality of connector members, one of the ends of said connector members being connected to spaced points of the lower portion of said suspension means, the other of the ends of said connector members being connected to spaced points of said retaining element, and means for adjusting the distance between said adjacent ends of the retaining element to control the tension of the suspension means when in operative position.

2. A water trampoline as defined in claim 1 wherein said retaining element is substantially annular in configuration when in operative position and said connector members are substantially rigid.

3. A water trampoline as defined in claim 1 wherein said means for adjusting the distance between said adjacent ends of the retaining element comprises a turnbuckle connected to said adjacent ends.

4. A water trampoline as defined in claim 1 including a protective sleeve of cushioning material surrounding each of said springs to protect a person using the trampoline from damage.

5. A water trampoline as defined in claim 4 including an annular cover having an outer edge portion and an inner edge portion and being disposed in overlying relationship to all of said sleeves so that no portion of the anatomy of a person using the trampoline can pass between adjacent ones of said springs.

6. A water trampoline as defined in claim 5 wherein the outer edge portion of said cover is connected to said springs to hold the outer portion of the cover in place.

7. A water trampoline as defined in claim 6 wherein the inner edge portion of said cover is provided with a drawstring to hold the inner portion of the cover in place.

8. A water trampoline as defined in claim 1 including a ladder comprising a plurality of ladder members, at least one of said ladder members being connected to said support means and at least one of said ladder members being connected to said suspension means.

9. A water trampoline as defined in claim 1 including tie-down flaps connected to the inner periphery of said support means for connection to a tie down means.

10. A water trampoline comprising a hollow inflatable support means having an inner periphery and an outer periphery, said inner periphery defining a space therewithin, means for inflating said support means with air, an elastic trampoline mat having an outer edge, a plurality of springs operatively connected to said outer edge, suspension means comprising a plurality of similar suspension members, each of said suspension members having an upper portion and a lower portion and an inner surface, said suspension members being interconnected with one another at the upper portions thereof, the upper portion of each of said suspension members being connected to certain ones of said springs, each of said suspension members extending around said support means with the inner surface of each of said suspension members in engagement with said support means, and retaining means connected to spaced points of the lower portion of each of said suspension members for retaining the lower portion of each of said suspension members in operative position, said retaining means including an elongated retaining element having opposite ends disposed adjacent one another, and a plurality of connector members, one of the ends of said connector members being connected to spaced points of the lower portion of said suspension means, the other of the ends of said connector members being connected to spaced points of said retaining element, and means for adjusting the distance between said adjacent ends of the retaining element to control the tension of the suspension means when in operative position.

11. A water trampoline as defined in claim 10 wherein each of said suspension members includes upper and lower edges, said upper and lower edges being provided with reinforcing means so that they will not tear during use.

12. A water trampoline as defined in claim 11 wherein the reinforcing means at the upper edges of adjacent suspension members overlap one another.

13. A water trampoline as defined in claim 10 wherein said retaining element is substantially annular in configuration when in operative position and said connector members are substantially rigid.

14. A water trampoline as defined in claim 10 wherein said means for adjusting the distance between said adjacent ends of the retaining element comprises a turnbuckle connected to said adjacent ends.

15. A water trampoline as defined in claim 10 including a protective sleeve of cushioning material surrounding each of said springs to protect a person using the trampoline from damage.

16. A water trampoline as defined in claim 15 including an annular cover having an outer edge portion and an inner edge portion and being disposed in overlying relationship to all of said sleeves so that no portion of the anatomy of a person using the trampoline can pass between adjacent ones of said springs.

17. A water trampoline as defined in claim 16 wherein the outer edge portion of said cover is connected to said springs to hold the outer portion of the cover in place.

18. A water trampoline as defined in claim 17 wherein the inner edge portion of said cover is provided with a drawstring to hold the inner portion of the cover in place.

19. A water trampoline as defined in claim 10 including a ladder comprising a plurality of ladder members, at least one of said ladder members being connected to said support means and at least one of said ladder members being connected to one of said suspension members.

20. A water trampoline as defined in claim 10 including tie down flaps connected to the inner periphery of said support means for connection to a tie down means.

21. A water trampoline as defined in claim 10 wherein the lower portions of said suspension members are of generally triangular configuration.

* * * * *